US007131743B2

(12) United States Patent
Leason et al.

(10) Patent No.: US 7,131,743 B2
(45) Date of Patent: Nov. 7, 2006

(54) CUSTOMIZABLE, ILLUMINATED HAIR BEADS

(76) Inventors: David Leason, 28 Garey Dr., Chappaqua, NY (US) 10514; Scott L. Sullivan, 3 Garden Ridge, Chappaqua, NY (US) 10514

( * ) Notice: Subject to any disclaimer, the term of this patent is extended or adjusted under 35 U.S.C. 154(b) by 75 days.

(21) Appl. No.: 10/637,939

(22) Filed: Aug. 7, 2003

(65) Prior Publication Data

US 2004/0031287 A1 Feb. 19, 2004

Related U.S. Application Data

(60) Provisional application No. 60/403,340, filed on Aug. 14, 2002, provisional application No. 60/403,339, filed on Aug. 14, 2002, provisional application No. 60/403,338, filed on Aug. 14, 2002, provisional application No. 60/403,337, filed on Aug. 14, 2002, provisional application No. 60/403,336, filed on Aug. 14, 2002.

(51) Int. Cl.
*F21V 99/00* (2006.01)

(52) U.S. Cl. ..... 362/104; 362/105; 63/3; 63/39; 2/905

(58) Field of Classification Search ..... 63/1.13, 63/13, 3, 4, 38–40; 362/104–106; 132/275; 2/905, 906, 209.13, 171; D28/92, 93
See application file for complete search history.

(56) References Cited

U.S. PATENT DOCUMENTS 2,572,760 A 10/1951 Rikelman
2,759,096 A * 8/1956 Caissie ..... 362/235
2,798,148 A * 7/1957 La Greca et al. ..... 362/103
3,061,715 A * 10/1962 Thomas ..... 362/235
3,450,872 A * 6/1969 Aiello, Jr. ..... 362/104
3,501,628 A * 3/1970 Madden ..... 362/104
3,944,803 A * 3/1976 Chao ..... 362/108
4,158,922 A 6/1979 Dana, III
4,237,525 A * 12/1980 Deter ..... 362/104
4,406,296 A * 9/1983 Wexler et al. ..... 132/148
4,779,172 A * 10/1988 Jimenez et al. ..... 362/104
4,848,009 A 7/1989 Rodgers
4,879,882 A * 11/1989 Johnson et al. ..... 63/4
4,894,757 A 1/1990 Frusha et al.
5,012,397 A * 4/1991 Tseng ..... 362/237
5,408,764 A 4/1995 Wut
5,438,493 A 8/1995 Tseng
5,483,759 A 1/1996 Silverman
5,497,307 A * 3/1996 Bae et al. ..... 362/104
5,946,728 A * 9/1999 Tane ..... 2/171

(Continued)

OTHER PUBLICATIONS

"LED Chaser" circuit diagram from aaroncake.net website (2 pages; printed Dec. 20, 2002).

(Continued)

*Primary Examiner*—Jack W. Lavinder

(57) ABSTRACT

A hair decoration such as a kit comprises a series of beads connectable to one another and a set of appliqués. At least a portion of the beads contains one or more lights inside which are in electrical communication with one another to permit power to be commonly supplied to the lights from a battery. One or more beads includes a mechanism for attaching the beads to hair. A light circuit is coupled to the light-containing beads to drive the lights. Appliqués in the set of appliqués are selectively applicable to the beads by a user, have a transmissivity, and are in a path of illumination of the lights. As a result, when the lights are driven by the light circuit, the lights shine and provide illumination in the path. The illumination can be direct or backlit. A method of decorating hair is also provided.

15 Claims, 5 Drawing Sheets

U.S. PATENT DOCUMENTS

| | | | | |
|---|---|---|---|---|
| 5,951,158 | A * | 9/1999 | Upah | 362/571 |
| 6,026,658 | A * | 2/2000 | Weller | 63/1.11 |
| 6,047,563 | A * | 4/2000 | DeRosa | 63/12 |
| 6,302,554 | B1 * | 10/2001 | Holce | 362/84 |
| 6,325,074 | B1 * | 12/2001 | Strawn | 132/277 |
| 6,626,009 | B1 * | 9/2003 | Ohlund | 63/3.1 |
| 2002/0089859 | A1 * | 7/2002 | Jackson et al. | 362/571 |
| 2002/0092323 | A1 * | 7/2002 | Lieberman | 63/38 |
| 2003/0026090 | A1 * | 2/2003 | Bornovski | 362/104 |

OTHER PUBLICATIONS

Novateck OTP 4-bit Microcontroller white paper, Ver. 2.0 (27 pages).
Novateck NTP66XX OTP Writer white paper, Ver. 2.0 (3 pages); and.
Novateck NT66 Series Programming Notice, Ver. 1.1 (3 pages).

* cited by examiner

CUSTOMIZABLE, ILLUMINATED HAIR BEADS

This patent application claims the benefit of priority under 35 U.S.C. § 119 from the following U.S. Provisional Applications: Ser. No. 60/403,336 entitled "Bead Arrangement And Method For Assembling And Securing The Same To A User's Hair;" Ser. No. 60/403,337 entitled "Customizable, Illuminated Hair Beads;" Ser. No. 60/403,338 entitled "Hair Beads With Motion- Or Sound-Responsive Circuit;" Ser. No. 60/403,339 entitled "Hair Ornament With Fragrance;" and Ser. No. 60/403,340 entitled "Self-Clamping Hair Ornament With Motion- Or Sound-Responsive Circuit," each of which was filed on Aug. 14, 2002 and which is incorporated herein by reference in their respective entireties.

FIELD OF THE INVENTION

The present invention relates to hair ornaments, and more particularly relates to illuminated beads that can be customized to, for example, spell out a person's or school's name.

BACKGROUND OF THE INVENTION

Hair can be styled and also can be adorned. Among various items that can be used to adorn hair, with or without changing its style, are hair beads. Conventionally, a hair bead is a wooden, plastic, ceramic or glass ornament that includes a throughbore sized to receive hair. The shape and ornamentation of such beads provides aesthetic appeal and can complement the wearer's hair style.

Traditionally, hair ornaments have provided their appeal in view of their innate appearance. There remains a need, however, for a hair ornament that includes circuitry that can illuminate beads from within, and, further, for a hair ornament that is customizable by the owner to spell out a message or illustrate an icon. The present invention addresses these and other needs.

SUMMARY OF THE INVENTION

In one aspect of the invention, a hair decoration kit comprises a series of beads connected to one another and a set of appliqués. At least a portion of the beads contain lights inside and those beads have no less than a first transmissivity which is suitable for permitting illumination from the lights to shine through the bead. A light circuit is coupled to the light-containing beads to drive the lights. Appliqués in the set of appliqués are selectively applicable to the beads by a user and have a second transmissivity which is less than the first transmissivity. As a result, when the lights are driven by the light circuit, the lights shine and provide backlight illumination to any previously applied appliqués.

In a related, yet broader aspect of the invention, a hair decoration includes a series of beads that are connectable to one another, at least a portion of the beads containing one or more lights therein and being in electrical communication with one another to permit power to be commonly supplied to the lights from a battery. A mechanism is provided for attaching the series of beads to hair. A light circuit is coupled to the beads that have lights in order to drive the lights. A set of appliqués having a transmissivity are included. At least one appliqué is in the set and is sized for application to a bead that has one or more lights therein, and for application to the beads along a path of illumination of the lights such that, when the lights are driven by the light circuit, the lights shine and provide illumination in the path.

In a further aspect of the invention, the hair decoration further has a motion-responsive or sound-responsive switch that is used to initiate the light circuit to drive the lights. The lights can be driven in a random pattern, in a sequence, or in one of a set of predetermined sequences. In one variation, beads for decorating hair can include a circuit that produces heat in response to a stimulus such as motion or sound. The heat can be used to increase the vaporization rate of a gel solid fragrance. In another embodiment, the circuit drives a piezoelectric element or a diaphragm to make sound or music. Common to all aspects and embodiments, however, is that the beads are attachable to a user's hair and are therefore susceptible to movement or the influence of sound due to their placement on the user's head. Also common to all embodiments, is a switch to activate the circuit.

In yet a further aspect of the invention, a motion-responsive switch can be exteriorly mounted and be viewable and accessible to a user. Such a switch comprises a part of the ornamentation of the hair ornament itself and can take the form of a conductive pendulum or pendant that is free to move into contact with a spaced away conductor. Contact between the pendulum and conductor constitutes a closure of the switch. A variety of ornamental and decorative shapes can be imparted to these two elements, and both can be free to move relative to one another.

Yet another aspect that can be included in a given embodiment is circuitry within the hair ornament that is energized upon securing the hair ornament to the user's hair.

In further aspects, the circuit can comprise a flashing-light circuit with one or more lights, and a reflective or diffusive surface can be provided to improve visibility of the lights when flashed; or a combination of these features can be included.

A hair decorating method that permits locks of hair on the head of a person or doll to be adorned includes the steps of providing a set of beads having various exterior configurations including a master bead and a plurality of accessory beads, permitting a user to arrange the accessory beads in an arbitrary series, and driving one or more illumination sources associated with each of the accessory beads using a circuit within the master bead, so that light shines exteriorly of the accessory beads.

Although the present invention is primarily directed to motion-responsive beads, many of the concepts discussed above can be employed in other fashion accessories. Moreover, instead of motion as the stimulus to activate the circuit, a variation on the foregoing is the use of a sound-activated switch, for example a pressure switch or a microphone-based discriminator circuit that establishes or varies a threshold sound level required to activate the circuit. Alternatively, the concepts herein can be implemented in circuitry that is activated by a switch that can be manually (i.e., deliberately) moved to a closed position, or by a combination of these approaches.

These and other aspects and features of the invention will be appreciated from the accompanying drawing figures and detailed description of certain embodiments of the invention.

BRIEF DESCRIPTION OF THE DRAWING FIGURES

DETAILED DESCRIPTION OF CERTAIN EMBODIMENTS OF THE INVENTION

The hair ornament of the present invention is described in connection with certain embodiments in which a series of beads, each containing a light source, comprises interconnected beads that are commonly powered by a battery source. The beads are preferably packaged with a set of appliqués from which a user can choose how to decorate the ornament. One or more of the arrangements, circuitry and switches described herein can be utilized to construct an embodiment of a hair decoration that responds to external stimulus to attract the attention of persons nearby, or to construct an embodiment of a hair decoration that can be easily applied to hair by a young user.

The series of beads can be constituted as described in U.S. Provisional Application Ser. No. 60/403,338, filed on Aug. 14, 2002, entitled "Hair Beads With Motion- or Sound-Responsive Circuit." The beads 12 may be of any conventional type and made from any of a variety of materials including wood, metal, glass, paper, plastic, or any combination thereof. Such decorative beads typically include a bore that extends through a portion of the bead and is sized and shaped to receive an object such as a power connection from another bead.

In the present invention, a portion of the beads is in electrical communication with one another so that lights contained in each bead can be energized in sequence, or randomly. The interconnection permits power to be supplied to the light sources in various beads from a central battery and enables one or more beads to house batteries or integrated circuitry for the benefit of the other beads in the series.

The light circuit can be a simple flashing light, using conventionally available blinking LEDs. A more sophisticated circuit causes the lights to flash in response to motion or sound using a motion- or sound-responsive switch. The light-flashing circuit can energize the lights in a sequence, as described below and in the aforementioned 60/403,338 application.

Figure 1:
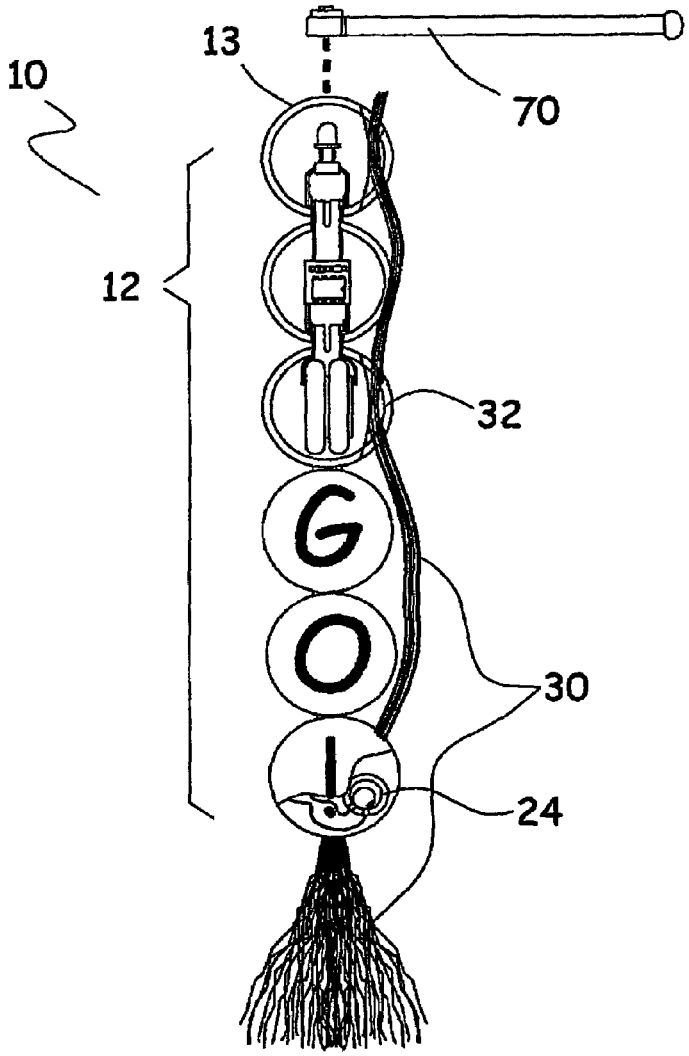
FIG. 1 illustrates a series of beads in accordance with an embodiment of the invention one bead shown with its outer surface partially broken away.

Turning now to FIG. 1, a series of beads 12 is shown. The beads depend from a barrette 70, which is used to attach the beads to hair. Other attachments can be used, such as a bobby pin, a comb, a clip, a barrette, a head band, a scrunchie, or an elastic hair-band. The adjacent beads 12 interlock with one another through a connection that permits a central battery and integrated circuitry to energize lights within the beads. The interlock can comprise a number of connections but a snap-fit is preferred because it can provide a universal joint between adjacent, coupled beads. A universal joint is preferred to other connections between the beads because it enables a series of beads to move relative to one another so that, when suspended from a body of hair by the fastener 70, the arrangement 10 conveys to an observer the illusion that the beads are strung around and surrounding the hair.

Within at least a portion of the beads is a light, preferably an LED. One such light is shown in the uppermost bead of FIG. 1, which is shown with its outer surface partially broken away. Internal to at least one of the beads is a battery that provides energy to illuminate the light. Preferably, an integrated circuit that is configured to flash the light sources is also provided in at least one of the beads and a motion- or sound-responsive switch is used to initiate a circuit response (e.g., flashing the lights or commencing an unpredictable delay before flashing the lights).

Rather than light emitting diodes, incandescent, electroluminescent, infrared or ultraviolet light sources may be used, and can be arranged anywhere on or within the beads 12.

The beads containing the light sources can all have a light transmissivity which is suitable for permitting illumination from the lights to through the bead. In other words, the candle power of the light source can exceed the opacity of the bead so that, at least in a dark room, the outer surface 13 will glow from the light within the bead. In this case, there are multiple light paths emanating from the bead in which the appliqué can be placed.

Figure 2:
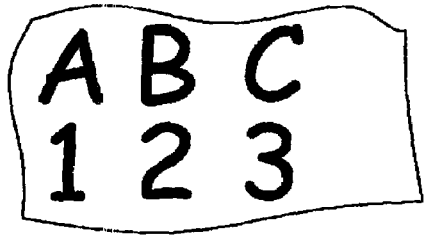
FIG. 2 illustrates an appliqué sheet bearing appliqués that can be added to the beads.

In FIG. 2, a sheet of appliqués is shown. The appliqués have a second transmissivity that is less than the first transmissivity. The appliqués are selected and applied to the beads that have lights in them by the user. Upon driving the lights with the light circuit, the lights shine and can provide backlight illumination to the applique. When the transmissivity of the appliqués is less than that of the bead (they include more opaque portions or in their entirety are more opaque), they are effective in masking the light source and presenting a back-lit image to an observer, illuminated by steady, flashing, or sequenced lights. On the other hand, the appliqué can have a greater transmissivity to directly light an image or letter, for example, when used with an opaque bead that has an exposed light path from the LEDs. The appliqués can comprise stickers, water-transfer tattoos, or dry transfer characters and icons, for example. Alternatively, the appliqués can comprise a clip that seats so as to be in the path of the light emitted from the light sources and can have transmissivities selected to pass or block light so that any letters/images thereon are either back lit or directly illuminated against a dark background. Such clips can be seated in a bore or channel or can include fingers to grasp the bead, or vice versa.

Figure 3:
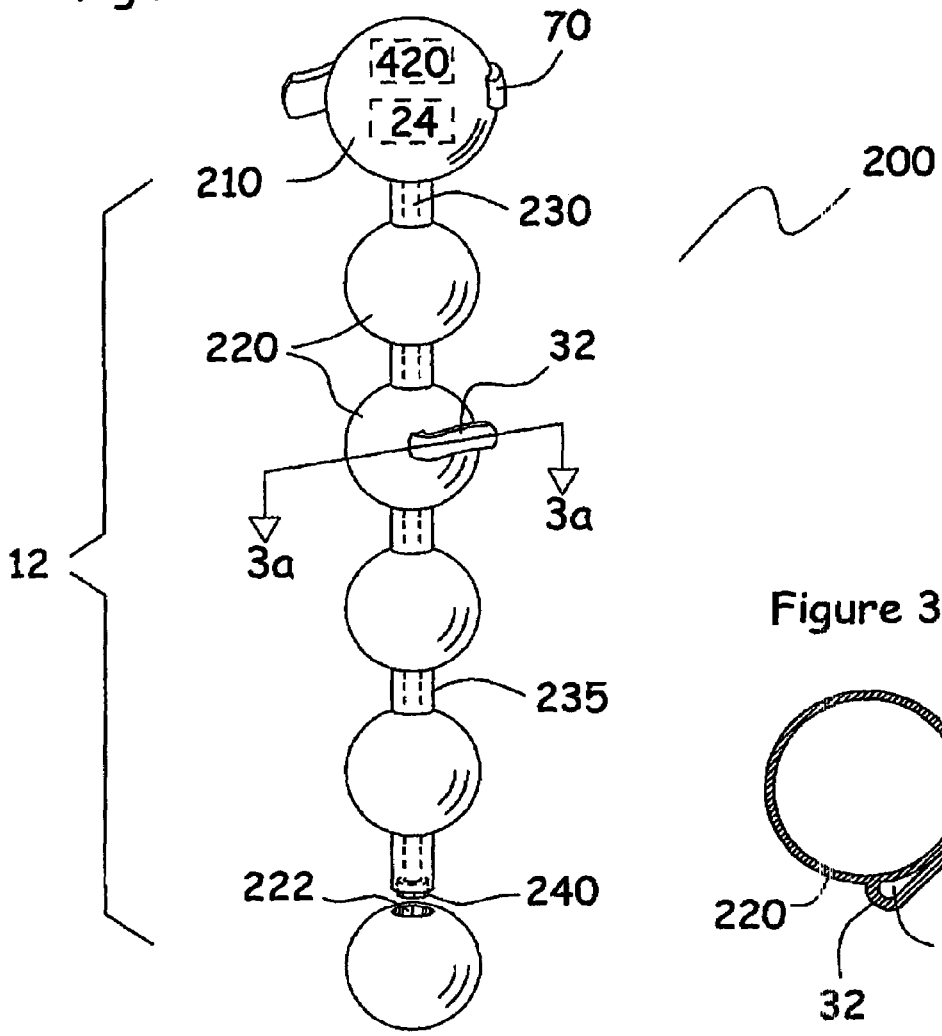
FIG. 3 illustrates a hair accessory in accordance with a preferred embodiment comprising a master bead connected to a series of accessory beads.
Figure 3A:
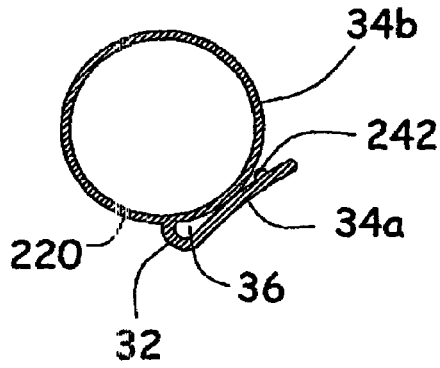
FIG. 3A is an enlarged top view of an accessory bead equipped with a clip for attachment to hair.

Use of a clip 32 enables a greater portion of the beads 12 to be reserved to house a battery or circuitry (e.g., one or more LEDs and interconnections to other beads) insofar as hair can be coupled to the bead near the bead's outer margin, while still providing the appearance that the hair extends generally centrally through all of the beads. FIGS. 3 and 3A illustrate a clip 32 that is sized and shaped to receive and hold onto hair bundle 30 so that hair bundle 30 is retained close to, but behind the series of beads 12. As shown in the detail of FIG. 3A, the clip 32 can have a resilient finger 34*a* that cooperates with a body portion 34*b* of the bead to retain the hair bundle 30 in a channel 36. Multiple clip-bearing beads can be interspersed throughout the strand in order to secure the bead strand to the wearer's head at a location remote from the fastener 70 (not shown) so that the free end of the bead strand (that is, the end having the hair end 48 discussed next) does not swing wildly from the user's head.

The clips 32 preferably include a structure that is configured to prevent the hair from exiting the hair-receiving slots inadvertently. In the preferred embodiment, this structure comprises a pin, cone, wall, or constriction 242 that divides the region below the clip to better grasp hair contained therein and to impede the hair accessory from sliding off the hair. That structure is preferably integrally formed with the bead 220.

Figure 1A:
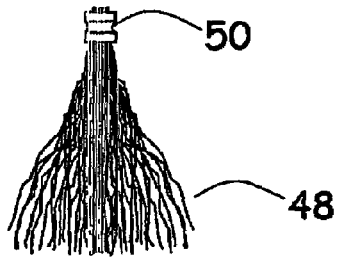
FIG. 1A illustrates an optional hair bundle that can be attached to the end of the series of beads.

At the end of the bead string, the wearer's own hair 30 can extend from the final bead as shown in FIG. 1, or a hair bundle 48 can be applied as shown in FIG. 1A. Use of a hair bundle 48 can provide the illusion that the beads are strung on the user's hair even if the series of beads depends from a barrette 70 or other hair attachment device. More particularly, hair ends 48 of different colors and different types can be provided, each including a bundle of real or synthetic hair of a particular color and type and secured as a bundle using a collet 50 or other mechanical connection such as a protuberance (as shown) that securely receives the bundle in the final bead in the series. As can be understood, selection and use of hair ends 48 permits a user to impart an appearance to the end of the decorative bead arrangement that insinuates the user's own hair color, or that accents the user's hair color in an arbitrary and perhaps whimsical manner.

With reference now to FIG. 3, an illuminated bead arrangement 200 in accordance with an embodiment of the invention can be constructed from a series of beads, one of which serves as a master bead 210 and the remainder comprise accessory beads 220 which the user assembles to the master bead and to other accessory beads. The master bead 210 can house, for example, a microcontroller 420, an inertial switch 24, and two button-cell batteries, as well as other components such as transistors, resistors, capacitors, oscillators and the like to establish signal amplification, timing, jitter control and other native settings common for digital circuits that employ microcontrollers. Accessory beads 220 are selectively connected to the master bead 210 via connecting cables 230 disposed, and preferably terminated, within a cover 235. The connecting cables preferably terminate in a plug 240 that is recessed within the cover 235. The plug 240 in this embodiment is received in a socket 222 of the accessory bead. The socket 222 includes contacts for conveying voltage from the microcontroller to each accessory bead at a magnitude that is sufficient to forward bias one or more LEDs contained in one or more accessory beads 220.

Figure 4:
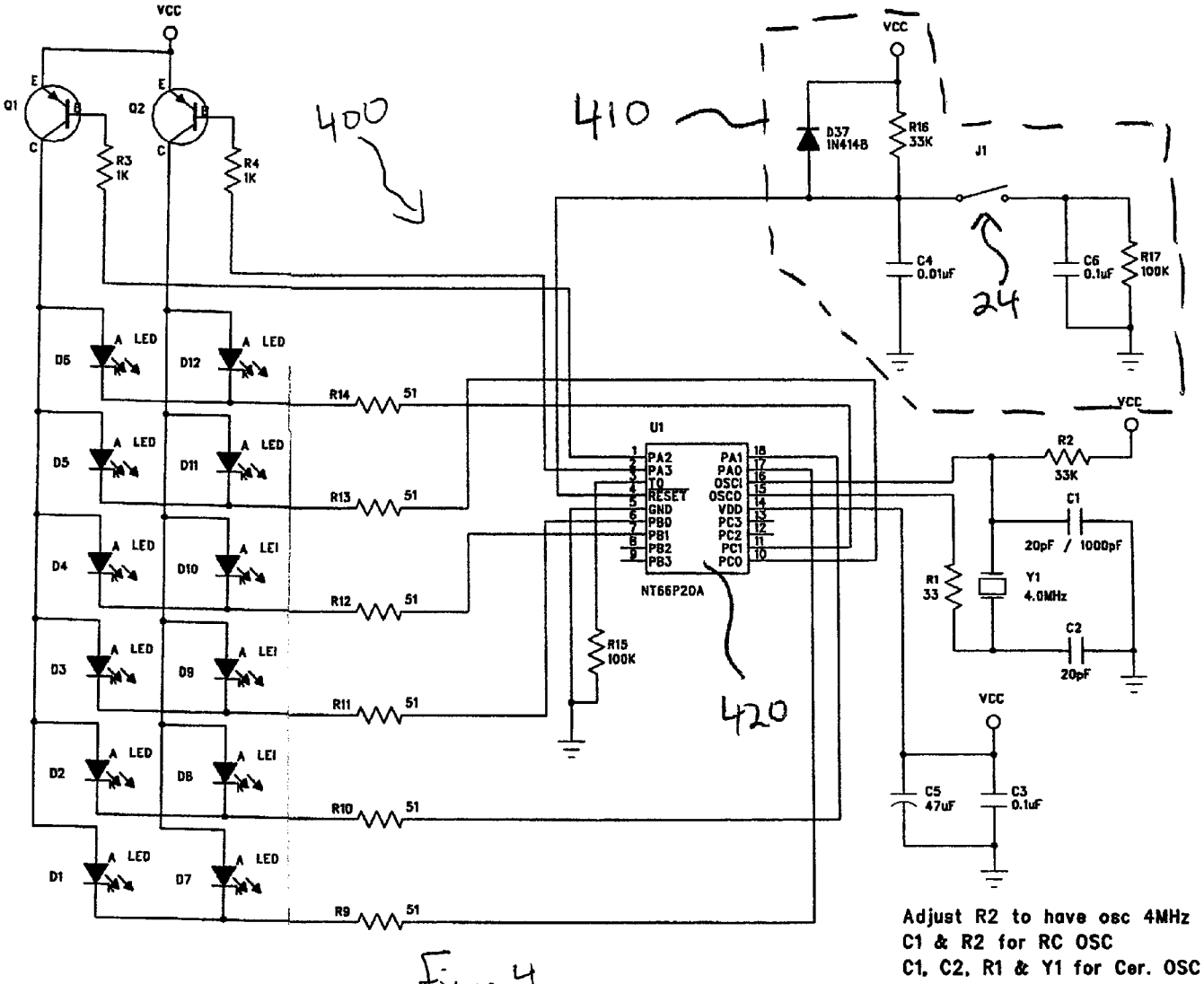
FIG. 4 is a circuit schematic for constructing a hair accessory in accordance with the preferred embodiment.

The signals to and from the LEDs can be configured as shown in the schematic of FIG. 4, which illustrates a circuit 400 that may be contained in the master bead 210 and which is connectable to LEDs D1–D12 via the plug 240. While the circuit of FIG. 4 is presently preferred, other circuits can be used, but all circuits used with hair ornaments as described herein are preferably responsive to either motion or sound. In its most basic form, the light-flashing circuit can include at least one light source and preferably a plurality of light sources such as light emitting diodes such as diodes D1 through D12, a source of power such as the battery (e.g., Vcc), and a switch 24 that intermittently connects the battery to the light sources to illuminate them. It should be appreciated, however, that other controllers can be used, such as, in lieu of the microcontroller 420 and LEDs, a digital signal processor or the like that can control the supply of analog signals that can drive a speaker, piezoelectric element or other component or load to produce sound or music instead of producing light as in the preferred embodiment. In a particular implementation, and with reference now to FIGS. 3 and 4, the microcontroller 420 is an NT66P20A microcontroller manufactured by NTK of Taiwan, which microcontroller can drive a maximum of thirty-six LEDs arranged in a matrix pattern using twelve signal lines. The illustrated embodiment of FIG. 3 has twelve LEDs. In such an implementation, two conductors are required to convey a drive voltage from the transistors Q1 and Q2 to the LEDs D1 through D12 and six more conductors are required to complete the circuit between these twelve LEDs and the microcontroller 420. If there were only ten LEDs, the total conductor count would be seven, as there would be no need for a conduct connecting LEDS D6 and D12 to pin PC1 of the microcontroller. The socket 222 preferably communicates with a circuit tracing internal to the beads 220, for example, a tracing on a printed circuit or a tracing formed directly upon or integral with the bead itself. These tracings convey power and signalss from the master bead 210 to successive beads 220 in the series so that they are in electrically communication with each other. Upon engaging the plug 240 into the socket, power is selectively provided to diodes in particular beads 220 at particular times in accordance with signals issued by the microcontroller 420.

The accessory beads 220 can be unique in that each can be internally configured (e.g., via the tracings) to connect a particular LED across a different pair of signal lines. The table below demonstrates the connection and addressing of the twelve LEDs denoted D1 through D12 of the embodiment of FIGS. 3 and 4, and further demonstrates how up to thirty-six LEDs can be driven using the NTK NT66P20A microcontroller. In the table, the row and column legends refer to the pins of the aforementioned NTK chip.

| | PA2 | PA3 | | PB2 | PB3 | PC2 | PC3 |
|---|---|---|---|---|---|---|---|
| PC1 | D6 | D12 | | D18 | D24 | D30 | D36 |
| PC0 | D5 | D11 | | D17 | D23 | D29 | D35 |
| PB1 | D4 | D10 | | D16 | D22 | D28 | D34 |
| PB0 | D3 | D09 | | D15 | D21 | D27 | D33 |
| PA1 | D2 | D08 | | D14 | D20 | D26 | D32 |
| PA0 | D1 | D07 | | D12 | D19 | D25 | D31 |

Referring to the table above, drive signals are provided to the pins in each of the columns of the table. In this embodiment, a transistor provides a voltage suitable for driving up to six LEDs; however, in variations on the circuit of FIG. 4, a transistor may not be required. A return path is defined by closing switches, which are in series with the pins in each of the rows of the table.

Figure 5:
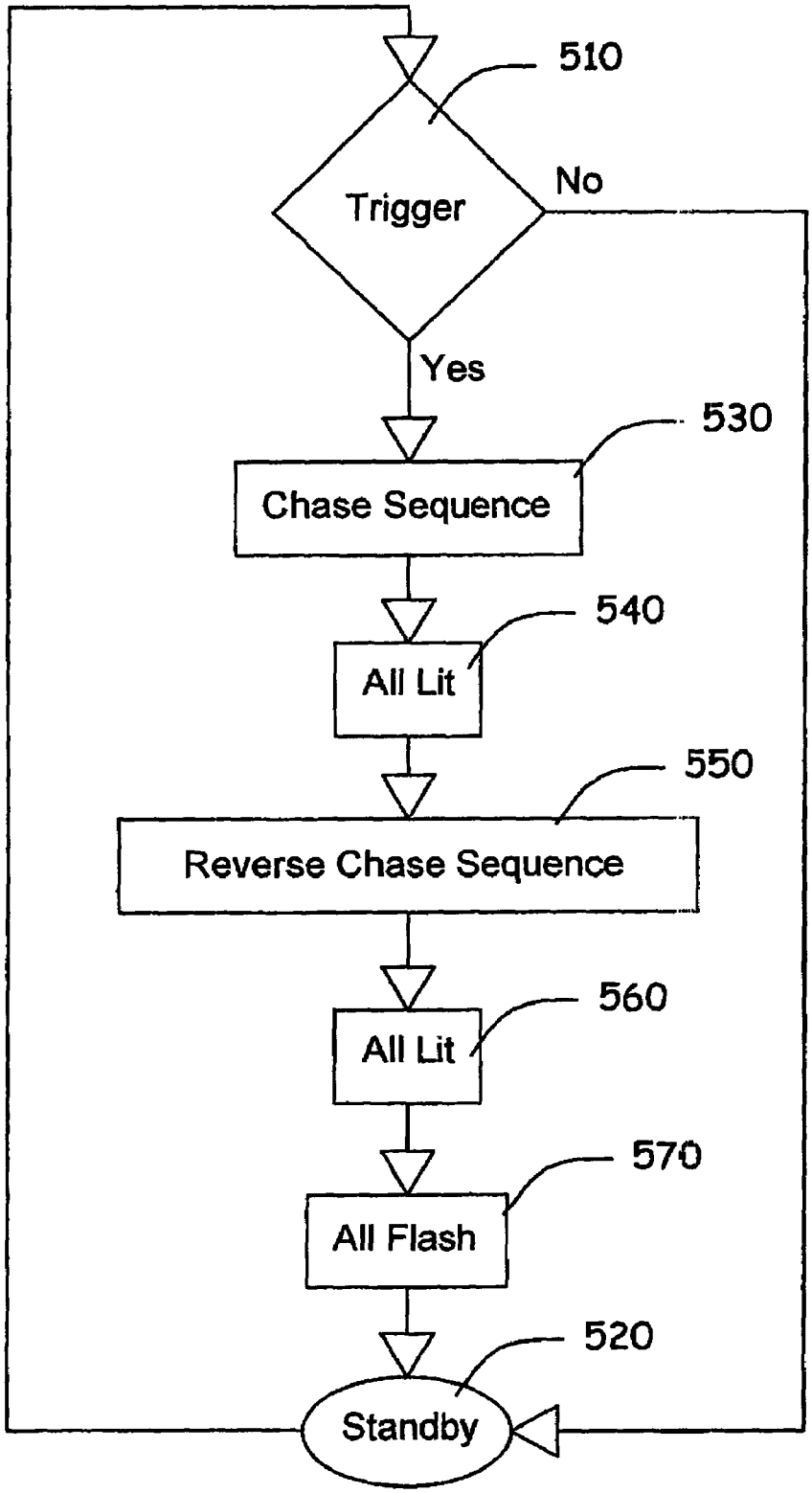
FIG. 5 is a flow chart illustrating operation of a hair accessory in accordance with the preferred embodiment.

Operation of this circuit is now described with reference to the flow chart of FIG. 5. The circuit 400 of the preferred embodiment commences an active operational state in response to a trigger event, as tested at step 510. The active state is defined by a program embedded or programmed into the microcontroller 420 that governs the distribution and timing of power delivery to the lights.

A trigger event preferably comprises movement of the inertial switch 24, which in the schematic of FIG. 4, comprises the switch J1 in a voltage pull-down circuit 410. Preferably, the switch J1 is a roller-ball switch that opens and closes upon movement of a ball into and out of engagement with a contact terminal, as described below. In alternate embodiments, the switch J1 can comprise a leaf- or coil-spring switch or a pressure- or sound-sensitive switch.

In the absence of a trigger event, the circuit 400 remains in a standby mode, as indicated by the loop 520 back to the trigger test 510. On the other hand, upon detecting a trigger event (e.g., when the roller ball engages the contact terminal to close the switch J1), a dynamic operational state is commenced. In the flow diagram of FIG. 5, the dynamic operational state comprises one or more of steps 530 through 570.

Illustratively, the operational state can include the sequence of steps 530, 540, 550, 560 and 570, with the microcontroller 420 thereafter returning to the standby state 520. At step 530, a chase sequence is commenced in which switches within the microcontroller are closed so as to send drive signals to sequentially illuminate and extinguish each of the LEDS D1–D12. At step 540, all of the LEDs connected to the master bead are illuminated for an interval in which all of the switches are closed so as to deliver drive signals to each of the LEDs all at once. At step 550, a reverse chase sequence is commenced which is the same as the chase sequence at step 530, except the LEDs are now illuminated sequentially starting at LED D12 and continuing back to LED D1. At step 560, all of the LEDs connected to the master bead are illuminated again, the same as in step 40, either for the same interval or a different interval. At step 570, all of the LEDs connected to the master bead are driven so as to flash on and off again, in phase with one another, by pulsing the drive signals that are delivered to their leads. Thereafter, the operational state terminates and the microcontroller 420 returns to the standy mode, as indicated by the loop back to step 520.

It should be understood that one or more of the steps 530 through 570 can be omitted or repeated and that these steps or any one or selection of them can be performed in various orders, including a dynamically selected order, on the basis of a program executed by the microcontroller 420. Thus, for example, steps 530 through 570 can be performed in response to a first trigger event, and steps 570 followed by step 550 can be performed in that order in response to a next trigger event.

In a particularly preferred implementation, ten accessory beads 220 having LEDs associated with each are provided and execute a prescribed pattern in response to a trigger event. Preferably, the pattern comprises a chase sequence from D1 up to D10 at a half second interval followed by flashing of all ten of the LEDS for, say, six seconds, followed then by a reverse chase sequence from D10 down to D1, at an interval of around a half second per bead, and back to standby.

Figure 7:
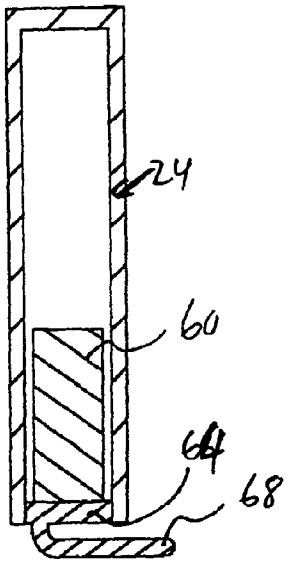
FIG. 7 is a sectional view taken along the line 7—7 of FIG. 6A.
Figure 6A:
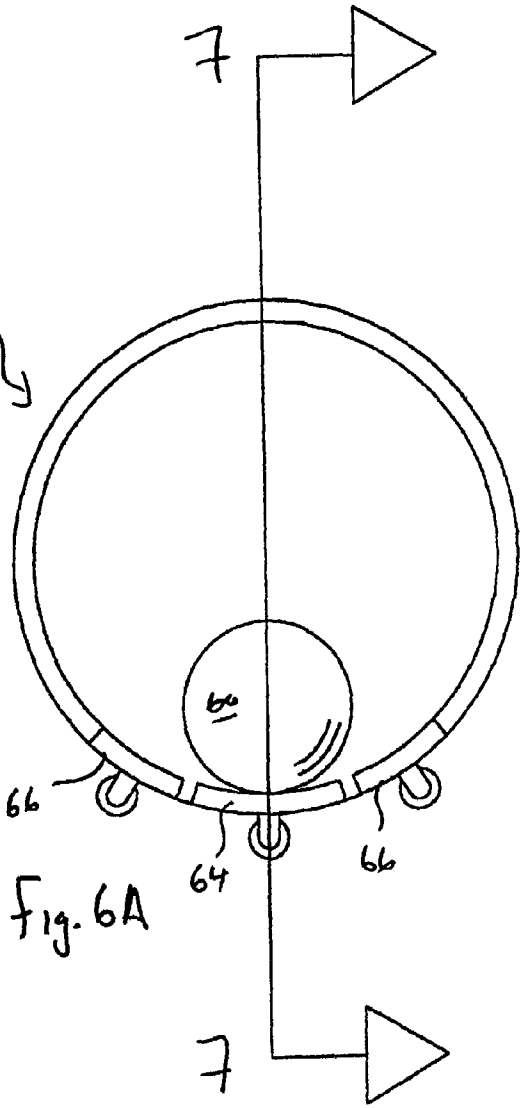
FIG. 6A is a sectional view on an enlarged scale of one embodiment of an inertial switch in a first state.
Figure 6B:
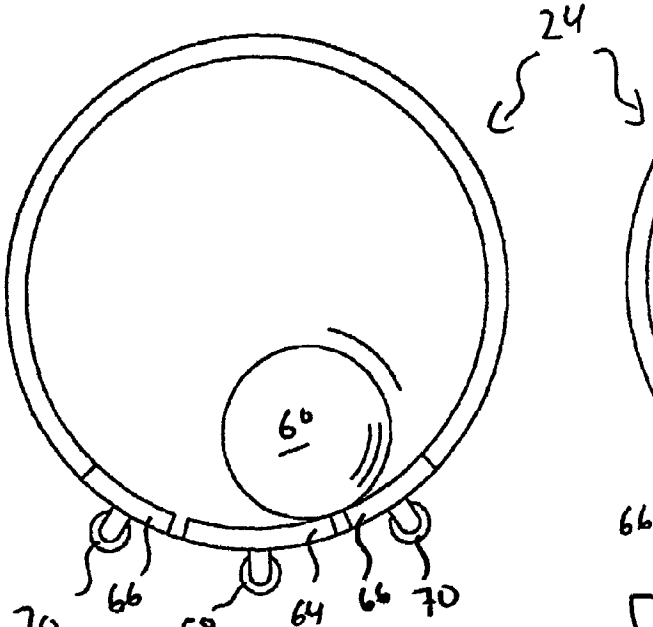
FIG. 6B is the same view showing the switch in a second state.

Reference is now made to FIGS. 6 and 7 in which a preferred switch 24 (J1 in FIG. 4) is described. The switch 24 is preferably a motion-responsive switch that alternates between open and closed states in response to motion of the hair ornament. For example, the switch 24 may comprise an electrically conductive metal ball rollable along a housing for making or breaking an electrical connection with an electrical terminal. As shown in the exemplary switch of FIG. 6A, the switch 24 can include an electrically conductive, metal ball 26 mounted with at least two degrees of freedom of movement in a sub-housing or chamber within one of the bead portions (see FIGS. 6A and 7). Due to the vertical orientation of the hair accessory 100 when in use, the housing preferably includes a concave interior lower wall 62 that supports the conductive ball 60. The ball is free to move within the sub-housing and come into contact with a terminal to close a circuit. Preferably the ball is always in contact with a first terminal 64 disposed centrally at the base (i.e., lowest point) of the concave interior lower wall. The ball is preferably sized so that in response to motion of the hair accessory, the ball rolls along the concave interior wall and so as to contact a second terminal 66 while still engaging the first terminal, as shown in FIG. 6B. More than one second terminal can be provided, and the first and second terminal can be spaced from the concave interior wall and contacted together when the ball 60 rolls a sufficient distance from its rest position at the base of the concave wall. The inertial switch 24 is closed when the ball contacts the first and second terminals 64, 66 simultaneously; otherwise, the inertial switch remains in an open state.

The first and second terminals can be connected in series with positive and negative terminals of the battery, via contacts 68, 70, respectively. The housing itself is constituted of an electrically insulating material, such as synthetic plastic material. Consequently, when the switch is closed, an electrical current from the battery is conducted to the light sources through the switch to cause the light sources to light and when the switch is open, the path is interrupted and no light sources are illuminated. When an integrated circuit component is used, the change of state of the inertial switch 24, i.e., from open to closed or from closed to open, can be used to trigger the component to initiate a flashing sequence in which the sources are lit in various random or predetermined patterns or can be used to trigger a delay circuit which in turn initiates a flashing sequence.

Alternatively, the switch 24 can be a mercury switch in which a ball of mercury runs back and forth along a tube between a pair of electrical contacts during motion of the footwear, as disclosed in U.S. Pat. No. 4,848,009. The switch can be a spring switch in which a cantilevered spring in the form of a coil oscillates back and forth to make and break contact with an electrical terminal as, for example, shown in U.S. Pat. No. 5,408,764. The switch may include a metal ball that moves with the motion of the supporting article (e.g., with the movement of footwear as shown in U.S. Pat. Nos. 2,572,760; 5,438,493; and 5,483,759). Each of these switches causes the lights to flash on and off, rather than be maintained continuously illuminated due to the mechanical movement of the mercury, metal balls, or oscillating spring switches. A corollary advantage is that battery life is increased while providing a more attractive eye-catching display of flashing lights.

As another alternative, the flashing effect can be produced electronically by use of an oscillator or flasher, preferably at low speeds on the order of a few Hertz, as for example described in U.S. Pat. No. 4,158,922. The switch 24 is then used not to make intermittent contact, but instead, a manual switch closure is employed to trigger the light circuit, such as circuit 400.

To prevent the battery from running low during transport of the hair accessory, a tamper can be disposed so as to prevent the switch from closing and extend exteriorly of the hair accessory's packaging so as to permit a retailer to remove or dislodge the tamper such that the accessory can display its capabilities to persons that move the packaging.

Instead of a motion-sensitive switch, a sound-activated switch can be utilized. A conventional microphone can be disposed on at least one of the beads 220 and arranged so that it is sensitive to exterior sounds. Depending on microphone sensitivity, it may be satisfactory to encase the microphone within the beads rather than expose the microphone's diaphragm to the bead exterior surface. The microphone is preferably coupled to a conventional discriminator circuit that has an established threshold level or that varies a threshold sound level required to activate the flashing-light (or other) circuit. In particular, the threshold level can be established dynamically at intervals on the basis of sound pressure received at the microphone. In this way, the flashing-light circuit can become less sensitive to ambient sounds and only respond to unusually loud sounds or sounds within a passband of selected frequencies (e.g., those of a child's voice, bass frequencies, etc.).

Various modifications and structural changes may be made without departing in any way from the spirit of the present invention. Thus, it should be recognized that the foregoing detailed description is to enable one of skill in the art to practice the invention and is not restrictive of the invention, which instead is defined solely by the recitations in the appended claims, which claims encompass the very methods and arrangements that include the elements recited in the claims as well as equivalents thereof.

We claim:

1. A hair decoration, comprising:

a series of beads connected to one another, at least a portion of the beads each including a power connection and containing one or more lights therein which are electrically interconnected through respective power connections and disconnectable for rearrangement so as to permit power to be commonly supplied to the lights from a battery when the portion of the beads are connected in an arbitrary series;

means for attaching the series of beads to hair;

a light circuit coupled to the portion of the beads to drive the lights, wherein the light circuit includes a micro-controller configured to provide power on selected ones of plural signal lines through the power connection so as to selectively provide power to the lights within any particular bead; and a switch responsive to one of motion and sound, wherein the light circuit drives the lights in response to the switch.

2. The hair decoration of claim 1, wherein there is a path of illumination of the lights such that, when the lights are driven by the light circuit, the lights shine and provide illumination in the path and wherein one of a letter and an image is disposed in the light path.

3. A hair decoration, comprising:

a series of beads connected to one another including at least a first bead and a second bead, at least a portion of the beads each including a power connection and containing one or more lights therein which are electrically interconnected through respective power connections and disconnectable for rearrangement so as to permit power to be commonly supplied to the lights from a battery when the portion of the beads are connected in an arbitrary series;

means for attaching the series of beads to hair, wherein the attaching means is proximate the first bead;

a light circuit coupled to the portion of the beads to drive the lights; and a switch responsive to one of motion and sound, wherein the light circuit drives the lights in response to the switch; and a clip on a surface of the second bead and shaped so as to permit selective engagement of the hair to the second bead.

4. A hair decoration, comprising:

a series of beads connectable to one another, at least a portion of the beads each including a power connection and containing one or more lights therein which are electrically interconnected through respective power connections and disconnectable for rearrangement so as to permit power to be commonly supplied to to lights from a battery when the portion of to beads are connected in an arbitrary series;

means for attaching the series of beads to hair;

a light circuit coupled to the portion of the beads to drive the lights; and a set of appliqués having a transmissivity, at least one appliqué being in the set and being sized for application to a bead among the portion of beads in a path of illumination of the lights, whereby, when the lights ore driven by the light circuit, the lights shine and provide illumination in the path.

5. The hair decoration of claim 4, wherein the light circuit has plural signal lines and wherein different particular combination of said plural signal lines connect through the power connection to lights within respective particular beads to individually drive the lights within the respective particular beads.

6. The hair decoration of claim 4, wherein the portion of the beads containing the lights has a first transmissivity and wherein the transmissivity of the appliqués is different than the first transmissivity.

7. The hair decoration of claim 6, wherein the first transmissivity is suitable for permitting illumination from the lights to shine through the portion of the beads and wherein the transmissivity of the appliqués is less than the first transmissivity, whereby the lights shine and provide backlight illumination to the at least one appliqué.

8. The hair decoration of any of claim 4, further comprising a switch responsive to one of motion and sound and wherein the light circuit drives the lights in response to the switch.

9. The hair decoration of claim 8, wherein the lights are driven in a random pattern.

10. The hair decoration of claim 8, wherein the lights are driven in one of a set of predetermined sequences.

11. The hair decoration of claim 8, wherein the switch is a motion-sensitive switch and wherein the switch is supported by one bead in the series of beads and the light circuit is contained within another bead in the series of beads.

12. The hair decoration of claim 4, wherein the series of beads includes at least a first bead and a second bead, wherein the attaching means is proximate the first bead, further comprising a clip attached to the second bead.

13. The hair decoration of claim 12, wherein the clip includes a structure to maintain the position of the second bead relative to the hair.

14. The hair decoration of claim 12, wherein the clip is on a surface of the second bead and is shaped so as to permit selective engagement of the hair to the second bead.

15. The hair decoration of claim 4, wherein the heads in the series of beads are connectable to one another by an interlocking engagement provided by the power connections.

* * * * *